US008147128B2

(12) United States Patent
Jouvenot

(10) Patent No.: US 8,147,128 B2
(45) Date of Patent: Apr. 3, 2012

(54) TIMEPIECE HAVING AN AUTOMATIC WINDING MECHANISM

(76) Inventor: Fredéric Jouvenot, La Chaux-de-Fonds (CH)

( * ) Notice: Subject to any disclaimer, the term of this patent is extended or adjusted under 35 U.S.C. 154(b) by 0 days.

(21) Appl. No.: 12/740,232

(22) PCT Filed: Oct. 24, 2008

(86) PCT No.: PCT/EP2008/064455

§ 371 (c)(1),
(2), (4) Date: Jul. 20, 2010

(87) PCT Pub. No.: WO2009/056498

PCT Pub. Date: May 7, 2009

(65) Prior Publication Data

US 2010/0278018 A1 Nov. 4, 2010

(30) Foreign Application Priority Data

Nov. 2, 2007 (CH) ..... 1707/07

(51) Int. Cl.
*G04B 5/00* (2006.01)

(52) U.S. Cl. ..... 368/207; 368/150

(58) Field of Classification Search ..... None
See application file for complete search history.

(56) References Cited

U.S. PATENT DOCUMENTS

| | | | | |
|---|---|---|---|---|
| 3,452,539 A | | 7/1969 | Iwasawa et al. | |
| 4,363,553 A | * | 12/1982 | Thomi et al. | 368/140 |
| 4,910,720 A | * | 3/1990 | Ray et al. | 368/148 |
| 5,377,171 A | | 12/1994 | Schlup | |
| 7,857,502 B2 | * | 12/2010 | Rochat | 368/212 |
| 2005/0007888 A1 | * | 1/2005 | Jolidon | 368/110 |

FOREIGN PATENT DOCUMENTS

| | | |
|---|---|---|
| CH | 524 853 A | 8/1972 |
| CH | 666 380 A | 7/1988 |
| CH | 682 201 A | 8/1993 |
| CH | 685 184 A3 | 4/1995 |
| CH | 692 537 A5 | 7/2002 |
| EP | 0 608 535 A1 | 8/1994 |
| EP | 1 826 633 A1 | 8/2007 |

OTHER PUBLICATIONS

International Search Report, dated Mar. 20, 2009, from corresponding PCT application.
Swiss Search Report, dated Jun. 5, 2008, from corresponding Swiss application.
Reymondin et al., "Theorie de l'horlogerie", Federation des Ecoles Techniques, 1998, pp. 225-252, ISBN 2-940025-10-X; Cited in specification.

* cited by examiner

*Primary Examiner* — Sean Kayes
(74) *Attorney, Agent, or Firm* — Young & Thompson

(57) ABSTRACT

A timepiece has a basic movement including at least one barrel (12) and a set of hands (14) for displaying the time now, the set of hands being situated at a first level, a mechanism for a supplementary function connected to at least one hand (18*a*) for displaying the supplementary function, the hand being situated at a second level and on a different axis from the set of hands (14), and an automatic winding mechanism for the barrel (12), including an oscillating mass (24) consisting of a carrier (24*a*) and a heavy sector (24*b*) situated at the periphery of the carrier. The carrier (24*a*) pivots in a plane situated between the first and second levels.

19 Claims, 4 Drawing Sheets

TIMEPIECE HAVING AN AUTOMATIC WINDING MECHANISM

TECHNICAL FIELD

The present invention relates to the field of mechanical horology. It more particularly concerns a timepiece including:

- a basis movement comprising at least one barrel and a set of hands to display the current time, said set of hands being situated at a first level,
- a mechanism for a supplementary function, associated with at least one hand to display the supplementary function, said hand being arranged at a second level and on a different axis from said set of hands, and
- an automatic winding mechanism of said barrel, comprising an oscillating mass made up of a carrier and a heavy sector situated at the periphery of the carrier.

The present invention has a particularly interesting application when the supplementary function mechanism is a chronograph.

STATE OF THE ART

Watches equipped with chronograph mechanisms are well known by those skilled in the art. One may in particular refer to the work "Théorie de l'horlogerie" by Reymondin et al, Fédération des Ecoles Techniques, 1998, ISBN 2-940025-10-X, pages 225 to 252, to find details on these mechanisms.

Also known are automatic winding mechanisms of a barrel equipping a watch movement, using the movement of an oscillating mass to actuate a ratchet winding the barrel. The aforementioned book provides information on these devices, on pages 169 to 188.

Certain watches are made from calibers designed, from the beginning, to include both a chronograph mechanism and an automatic winding mechanism. However, the oscillating mass traditionally being arranged on the back side, it at least partially hides the fineness of the chronograph mechanism, while also increasing the thickness of the movement. Moreover, the presence on the bottom side of an oscillating mass prevents the addition of a supplementary complication, such as a simple or double fly-back system, for example, which must indeed be placed on the bottom side.

Moreover, most of the watches provided with a well-crafted chronograph use manual winding. Their advantage is to show, on the bottom side and therefore visible for the user if the watch is provided with a transparent bottom, the complexity of the chronograph mechanism. However, the users of such watches must wind them daily if they want these watches to remain accurate in terms of the time.

A first solution to this problem would be to add a conventional automatic winding mechanism to a chronograph mechanism. However, such a modification would ruin the esthetics of the complication by hiding at least part of it. One could situate the automatic winding system on the side of the bottom, as proposed by document CH 666 380. However, this is made impossible by the fact that there is simply not room to access the ratchet of the barrel. Moreover, the presence of the counters of the chronograph on the side of the bottom, not concentric to the main set of hands, also greatly complicates such a construction.

BRIEF DESCRIPTION OF THE INVENTION

The aim of the present invention is the offset these drawbacks. More precisely, it concerns a timepiece as stated in the first paragraph of this application, in which the carrier of the oscillating mass pivots in a plane situated between the first and second levels.

In one preferred embodiment, the supplementary function mechanism is a chronograph.

The timepiece can also have one or the other of the following features:

- the oscillating mass pivots in the center of the movement;
- the oscillating mass is situated so as to leave the hand visible to display the measured time when it is in the reading position, the reading position advantageously being able to correspond to the locking position of the oscillating mass;
- it comprises a hand to display the second of the current time, the latter and the hand for displaying the measured time each pivoting along an axis situated at the center of a counter, these counters being aligned relative to the center of the movement;
- the edge of the oscillating mass has two circular recesses, having for center the pivot axes of the hands for displaying the second of the current time and the measured time, when the mass is in its reading position;
- the oscillating mass has a blank to allow supplementary information to appear when the oscillating mass is in the reading position;
- the automatic winding mechanism is situated in an additional module;
- the barrel being provided with an arbor and a ratchet integral with the arbor for its winding, one of the ends of the arbor is located in the thickness of the module, and a second ratchet is integral in rotation on the end, this second ratchet being kinematically connected with the automatic winding mechanism;
- the arbor rotates in an additional bridge situated at a lower level relative to the plane of the carrier; and
- the heavy sector is situated at a level even with or lower than the second level.

BRIEF DESCRIPTION OF THE DRAWINGS

Other characteristics of the present invention will appear more clearly upon reading the description which follows, done in reference to the appended drawing, in which.

DETAILED DESCRIPTION OF THE INVENTION

Figure 1:
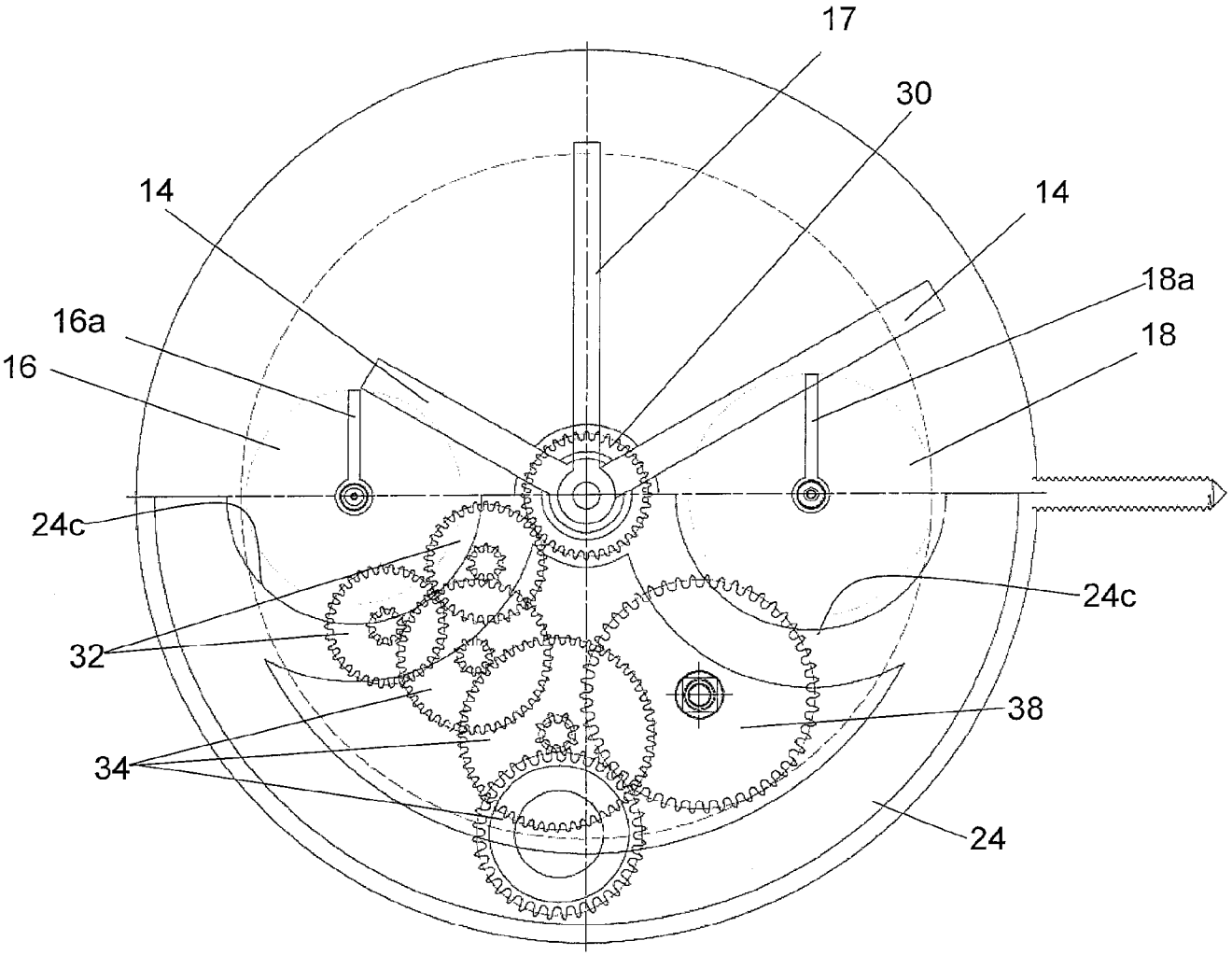
FIGS. 1 and 2 are simplified top and cross-sectional views, respectively, of one preferred embodiment of the invention.
Figure 2:
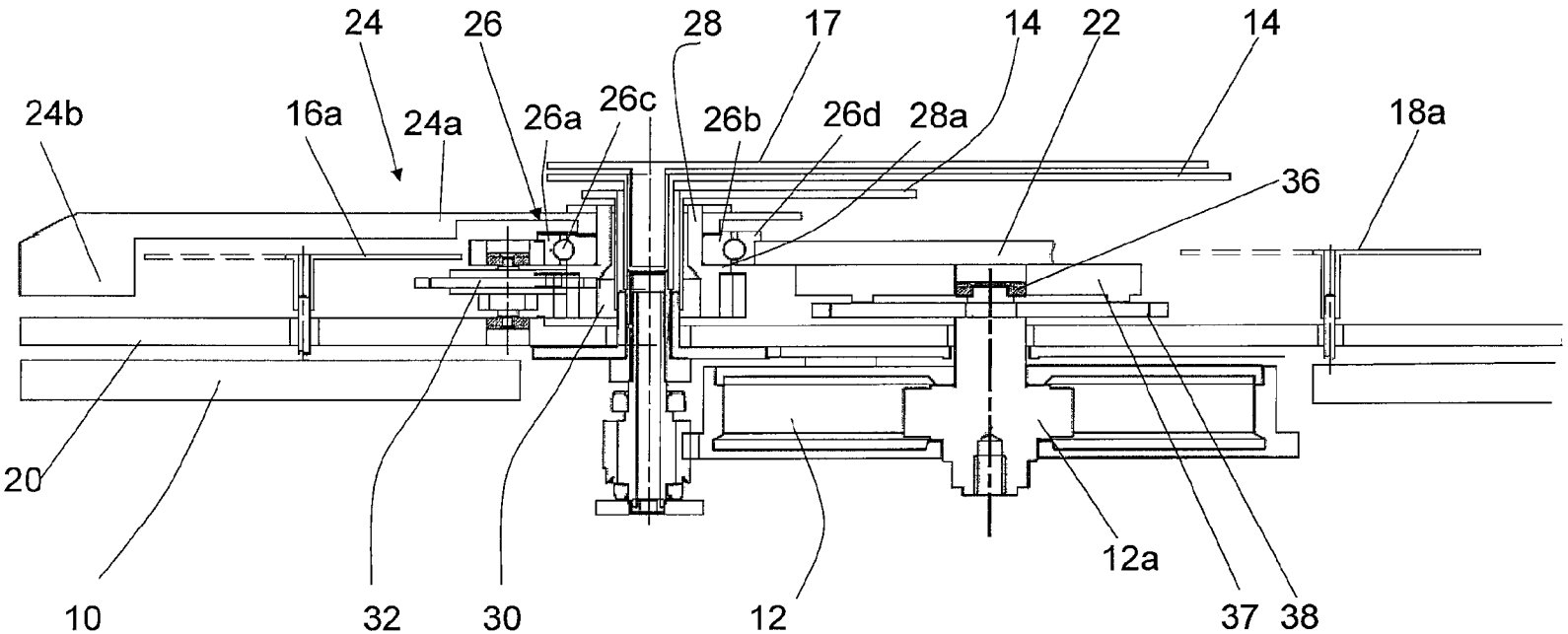

In this document, the terms "lower" and "upper" must be understood in reference to FIG. 2. Thus, an element situated at a lower level relative to another means that it is located closer to the bottom side of the movement. Vice versa, an upper level in reference to another is a level located closer to the dial side.

According to one preferred embodiment serving as an example for this description, the invention assumes the form of a module situated on a basis movement that is not shown, with the exception of a few elements useful for the understanding of the invention. These elements are essentially:

- an upper plate 10, defining the upper face of the basis movement, i.e. that situated on the dial side,
- a barrel 12 supplying energy to the movement and possible complications equipping the movement, hands 14 to display the hour and minute of the current time, situated at a first level, in this example, at the center of the movement.

More precisely, the first level is defined by the lowest hand relative to the movement, i.e. in general the hour hand. One will note that the term hand must not be interpreted limitingly and be reduced to one form, but must rather be understood as an index situated on the dial, in reference to a watch glass, conversely to a disk, generally arranged under the dial.

The person skilled in the art may recognize certain elements of the minute train allowing the driving of the hands 14. One can also see a first counter 16 to display the second of the current time, in the form of a small seconds-hand at 9:00. These elements not being essential, they will not be described in further detail. The movement also includes a conventional chronograph mechanism, the elements of which are not visible in the figures. Only illustrated are a hand 17 to display, at the center, the second of a measured time, and a second counter 18 situated at 3:00 and serving, in a usual manner, to display the minutes of the measured time. The hand 17 is located at a higher level relative to the hands 14. The counters are normally situated on the 9:00-3:00 axis of a watch in which the module is mounted.

Each counter comprises, in its center, a hand 16*a* and 18*a*, respectively, driven from the basis movement. The hands 16*a* and 18*a* are generally situated in a same plane and define a second level. If applicable, the second level is defined by the highest hand relative to the movement.

As explained above, the aim of the present invention is to be able to have an automatic winding mechanism, compatible with the chronograph mechanism equipping the movement. Advantageously, the elements which will now be described and which are part of the automatic winding mechanism are placed in the additional module, which makes it possible to add it to an existing basis movement not specially designed to receive it.

This module comprises a lower plate 20 and an upper plate 22. The frame is designed to be placed on the plate 10 of the basis movement, to be made integral therewith. The plates 20 and 22 include openings adapted for the passage of the hands 14, 17, 16*a* and 18*a* of the basis movement. The upper plate 22 can even be greatly blanked and only be present in locations where it houses pivot means for the elements of the automatic winding mechanism. In FIG. 2 one can see that the upper plate 22 is blanked at the level of the counters 16 and 18.

According to the invention, an oscillating mass 24 pivots on the dial side, at the center of the movement. More particularly, the oscillating mass 24 is made up of a carrier 24*a*, preferably assuming the form of a board which can be openwork, and a heavy sector 24*b* situated at the periphery of the carrier. The carrier 24*a* is positioned in a plane located between the first and second levels above. The heavy sector 24*b* is located, relative to the center of the movement, at a greater distance than the counters 16 and 18 and can, then, be found at a different level of the carrier 24*a*, and possibly, as shown in FIG. 2, be located partially at the abovementioned second level. Thus, the mass 24 can oscillate freely, its carrier moving under the hands 14 and over the hands 16*a* and 18*a*.

Advantageously, the pivoting of the oscillating mass 24 is realized using a ball bearing 26. More precisely, the bearing 26 comprises an outer ring 26*a* fixed to the upper plate 22 of the module, and an inner ring 26*b*, balls 26*c* being inserted between the two rings. The outer ring 26*a* is adjusted in the upper plate 22 and has, at its outer diameter, a step 26*d* designed to bear on the plate 22. This step allows positioning of the bearing at a precise height.

The lower ring 26*b* is passed through by a tube 28 integral therewith and which receives the oscillating mass 24, in a fixed manner. The pipes of the hands 14 and 17 pass inside the tube 28. One can see that the tube 28 has, at its base, on the movement side, a portion of greater diameter, which can have an annular shoulder 28*a* constituting a base for the bearing 26, which is thus perfectly positioned. Owing to the step 26*d* and the shoulder 28*a*, the oscillating mass 24 can be arranged with great precision in the chosen plane.

At its base, the tube 28 receives a pinion 30 integral therewith and which is therefore driven by the oscillations of the mass 24. This pinion 30 is engaged with an automatic winding train of the conventional type, comprising, for example, two reversers 32 and reduction trains 34, these elements pivoting between the plates 20 and 22 of the module. Any type of automatic winding mechanism known by the person skilled in the art can be used for the present invention.

The barrel 12 includes an arbor 12*a* on which a ratchet is integrally mounted, the latter part serving for manual winding of the barrel. In the state of the art, this ratchet is also actuated by automatic winding mechanisms when the movement is equipped therewith. However, the complexity of the chronograph mechanisms makes it impossible to bring the energy supplied by the oscillating mass 24 to the ratchet of the barrel, located in the basis movement. To offset this drawback, the barrel arbor 12*a* is modified, such that it passes through the plate 10 of the basis movement and the plate 20 of the module, such that its end is located in the thickness of the module. To allow the pivoting of the arbor 12*a*, pivot means, such as a stone 36 for example, are situated in an additional bridge 37, integral with the module. One could also provide pivot means situated in the lower plate 20 of the module, but such an embodiment is more difficult in terms of the arbor.

An additional ratchet 38 located in the thickness of the module is fixed at the end of the arbor 12*a*. That ratchet 38 meshes with the last train 34 of the automatic winding mechanism, to allow the winding of the barrel. One will note that the manual winding system situated in the basis movement remains completely functional. As one skilled in the art knows, the automatic winding mechanism comprises a disconnection system disconnecting the kinematic chain from the automatic winding mechanism when the barrel is wound manually.

The mechanism according to the invention can have additional advantages. As shown in FIG. 2, the elements of the automatic winding mechanism, in this case a reverser 32, can be superimposed on the surface swept over by the hands 16*a* and 18*a* of the counters, which makes it possible to optimize the space occupied by that mechanism.

Situating the heavy sector 24*b* beyond the surfaces occupied by the counters 16 and 18 and therefore outside the travel of the hands 16*a* and 18*a* makes it possible to greatly limit the thickness of the module. Depending on the case, it is even possible for the heavy sector to be at least partially located in the thickness of the basis movement.

Moreover, the oscillating mass 24 is blanked or shaped such that, when the timepiece is in the reading position, i.e. when it is arranged naturally so that the user looks at the counters 16*a* and 18*a*, the latter parts are visible for a user to allow reading of the measured time. In general, the reading position corresponds to the locking position of the oscillating mass 24, i.e. the position in which its center of gravity and its center of rotation are vertically aligned, along a 12:00-6:00 axis. Typically, for a bracelet watch, the reading position corresponds to the position of the watch when the wearer brings the wrist toward him, the back of the hand being close to the sagittal plane of the wearer and oriented toward his eyes.

According to one preferred embodiment, the edge of the oscillating mass 24 has two circular recesses 24*c*, having for center the pivot axes 16*a* and 18*a*, when the mass 24 is in its locking position. Such a blank which reuses the shapes of the counters makes it possible to improve the readability of the information by drawing the eye, which will immediately focus its attention on the counters 16 and 18, favoring quick reading.

One will note that it is possible to do without the dial to save thickness and make the movement of the oscillating mass 24 and the automatic winding mechanism visible.

The description above was provided as a non-limiting example of the invention. Different alternatives may be imagined by the person skilled in the art, without going beyond the scope of the invention. The principle of the arrangement of the automatic winding mechanism, particularly of the oscillating mass 24, as well as its shape, can certainly be integrated into a basis movement, from its design. The oscillating mass 24 can be blanked to allow, in its locking position, additional information to appear, such as a date at 5:00 or 6:00, or an hour counter, often situated at 6:00.

The carrier 24*a* of the oscillating mass 24 can be made in a transparent material so that the counters are always visible. To have other esthetic effects, the person skilled in the art could provide for having several oscillating masses, each pivoting around the axis of the counter hands and kinematically connected to the supplementary ratchet. Particularly in that case, but also with a single oscillating mass in the center, the display of the counters can be retrograde. Thus, even with an oscillating mass of generally semi-circular shape and not including any particular blanking, the counters remain visible when the mass(es) is(are) in the locking position.

Figure 3:
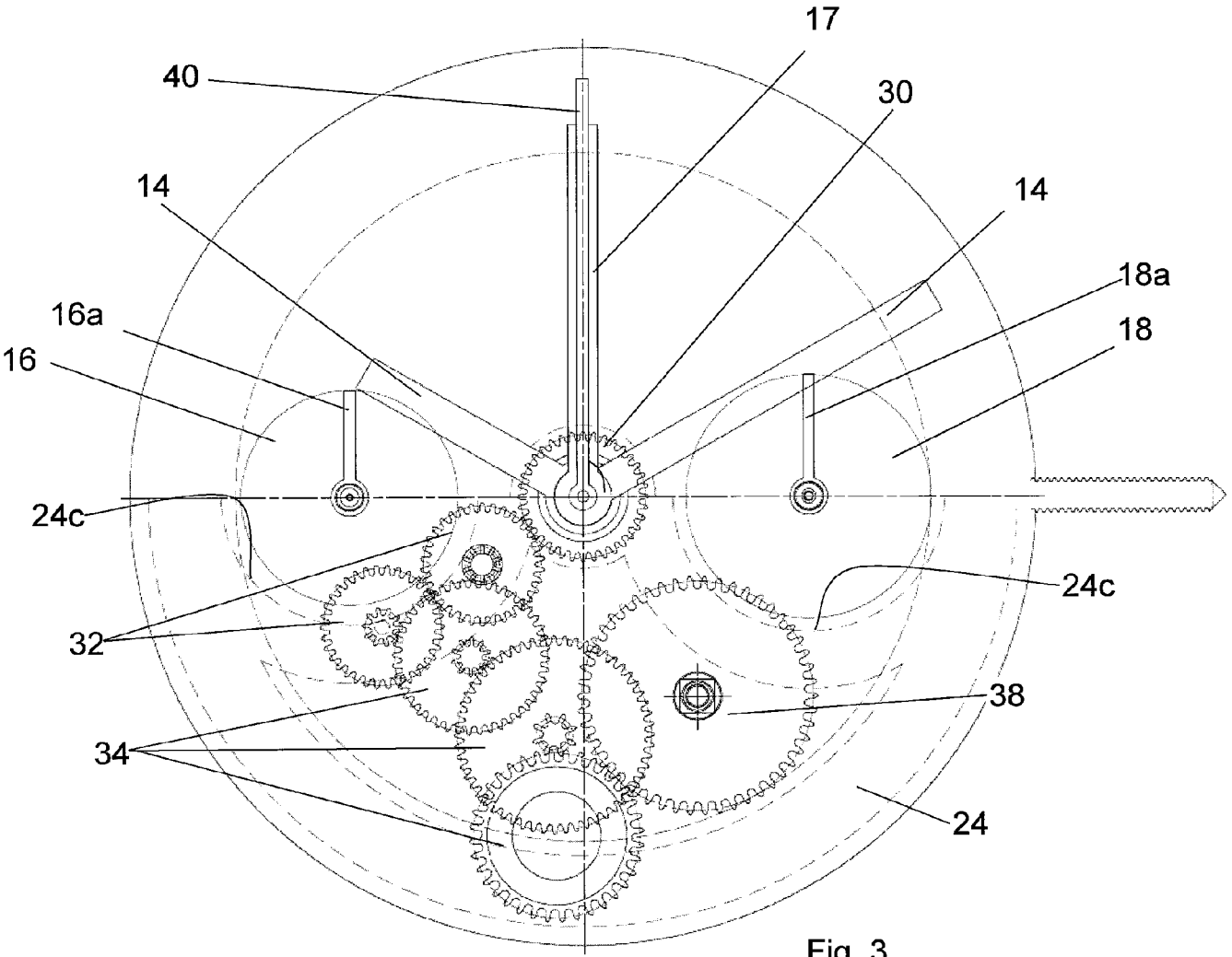
FIGS. 3 and 4 are simplified top and cross-sectional views, respectively, of a second embodiment of the invention.
Figure 4:
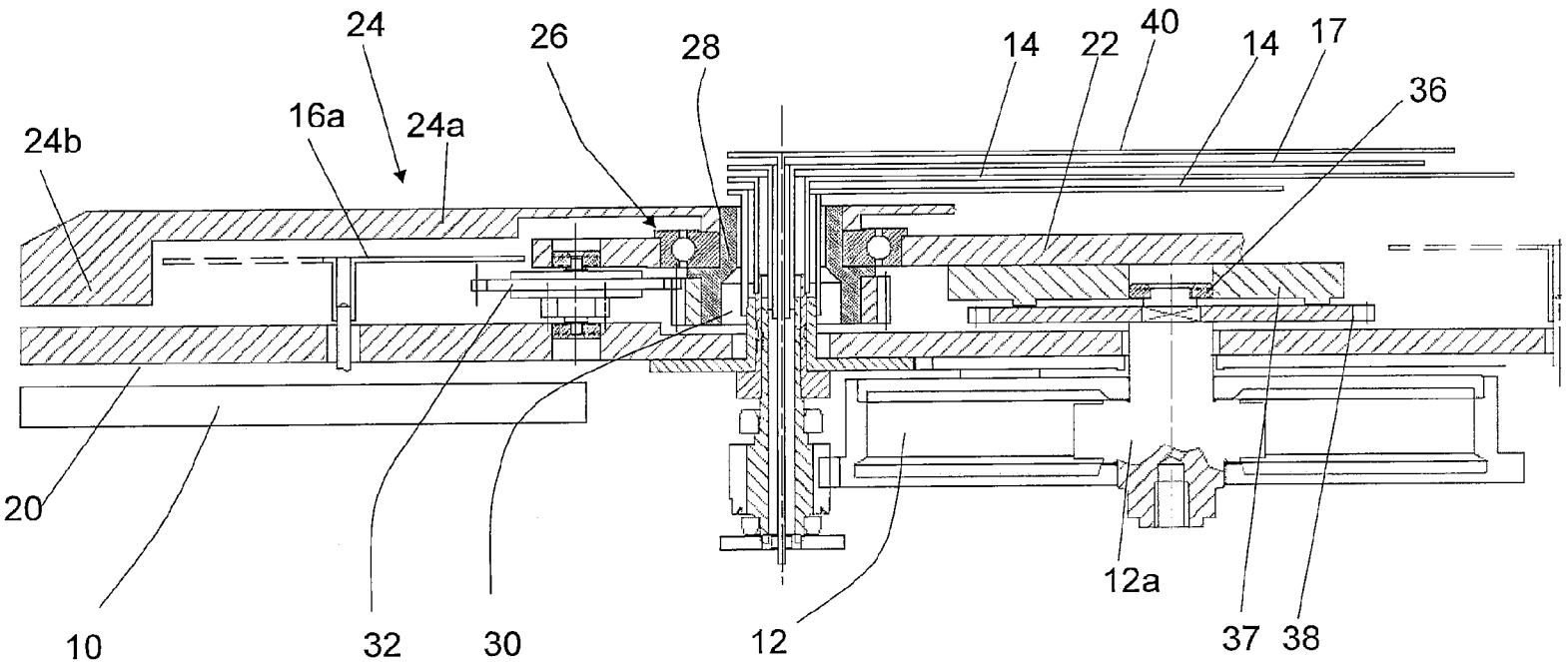

One will also note that the oscillating mass can pivot at any location of the movement. Lastly, the proposed mechanism is also completely compatible with complications of the fly-back hand type, as shown by FIGS. 3 and 4. A pipe of a fly-back hand 40 can very easily pass at the center of the piece, inside the pipe of the hand 17, to be mounted on a fly-back wheel, not shown. This alternative has the advantage of making the fly-back mechanism visible on the bottom side whereas in automatic chronographs, it is always mounted on the dial side and is therefore generally not visible from the outside.

Thus obtained is a winding mechanism which can be adapted to a movement including a chronograph mechanism, leaving completely visible, on the bottom side, the fineness and complexity of the chronograph mechanism. The esthetic of the oscillating mass visible on the dial side, without hindering either the operation or the reading of the counters, is also particularly interesting. One will note that, in a simplified alternative, it is possible to situate a winding mechanism according to the teaching of the invention in a movement equipped with a chronograph module. Naturally, the chronograph mechanism is then not visible through the bottom, but the piece thus equipped preserves an original esthetic due to the positioning of the oscillating mass.

The invention is not limited to a timepiece provided with a chronograph. The person skilled in the art can directly deduce from the technical teaching provided above, the possibility of realizing a timepiece provided with one or several supplementary functions, for example displayed in place of the counters 16 and 18. One could thus consider having, in a first counter, a date indicator and in the other, a power reserve indicator, the second of the current time then, in such a case, being able to be displayed by a hand mounted in the center, like the hand 17. One can also add a supplementary function in addition to a chronograph, the function being displayed in a third counter. The additional functions can in particular be a GMT, a moon phase, a wake-up time or any other indication which can be displayed above the dial.

The invention claimed is:

1. A timepiece including:

a basis movement comprising at least one barrel and a set of first hands to display the current time, said set of first hands being situated at a first level, a mechanism for a supplementary function, associated with at least one second hand to display information different from the current time displayed by first hands, said second hand being arranged at a second level and on a different axis from said set of first hands, on the same side of the basis movement as said first hands, and an automatic winding mechanism of said barrel, comprising an oscillating mass made up of a carrier and a heavy sector situated at the periphery of the carrier, wherein said carrier pivots in a plane located between said first and second levels.

2. The timepiece of claim 1, wherein the oscillating mass pivots at a center of the movement.

3. The timepiece of claim 2, wherein the oscillating mass is arranged so as to leave said second hand visible to display the supplementary function when it is in a reading position given by a user carrying said timepiece to a wrist and reading information provided by said timepiece.

4. The timepiece of claim 3, wherein the center of gravity of the oscillating mass is aligned on a 6:00-12:00 axis when said piece is in its reading position.

5. The timepiece of claim 2, wherein said mechanism of the supplementary function is a chronograph arranged to provide a measured time by means of at least said second hand.

6. The timepiece of claim 5, comprising a third hand to display the second of the current time, said third hand and said second hand to display the measured time pivoting each along an axis arranged at a center of a counter, said counters being aligned relative to the center of the movement.

7. The timepiece of claim 1, wherein the oscillating mass is arranged so as to leave said second hand visible to display the supplementary function when it is in a reading position given by a user carrying said timepiece to a wrist and reading information provided by said timepiece.

8. The timepiece of claim 7, wherein the center of gravity of the oscillating mass is aligned on a 6:00-12:00 axis when said piece is in its reading position.

9. The timepiece of claim 7, wherein said mechanism of the supplementary function is a chronograph arranged to provide a measured time by means of at least said second hand.

10. The timepiece of claim 9, comprising a third hand to display the second of the current time, said third hand and said second hand to display the measured time pivoting each along an axis arranged at a center of a counter, said counters being aligned relative to the center of the movement.

11. The timepiece of claim 7, wherein the oscillating mass has a blank to allow supplementary information to appear when said oscillating mass is in the reading position.

12. The timepiece of claim 1, wherein said heavy sector is situated at a level even with or lower than the second level, lower meaning in direction of the basis movement.

13. The timepiece of claim 1, wherein said mechanism of the supplementary function is a chronograph arranged to provide a measured time by means of at least said second hand.

14. The timepiece of claim 13, comprising a third hand to display the second of the current time, said third hand and said second hand to display the measured time pivoting each along an axis arranged at a center of a counter, said counters being aligned relative to the center of the movement.

15. The timepiece of claim 13, wherein the oscillating mass presents an edge, the edge of the oscillating mass has two circular recesses, having for center the pivot axes of the second and third hands to display the second of the current time and to display the measured time, when said timepiece is in a reading position given by a user carrying said timepiece to a wrist and reading information provided by said timepiece.

16. The timepiece of claim 13, wherein the chronograph mechanism comprises a supplementary hand provided with a first pipe and mounted coaxial to the first hands to display the current time, wherein the basis movement comprises, moreover, a fly-back mechanism provided with a fly-back hand also situated coaxial to the first hands to display the current time, said fly-back hand being provided with a second pipe positioned inside the first pipe of said supplementary hand.

17. The timepiece of claim 1, wherein the automatic winding mechanism is arranged in a module mounted on the basis movement.

18. The timepiece of claim 17, wherein the barrel is provided with an arbor and with a ratchet integral with the arbor for winding said barrel, and wherein a first end of the arbor is situated within the module, and wherein a second ratchet is integral in rotation on said first end, said second ratchet being kinematically connected with the automatic winding mechanism.

19. The timepiece of claim 18, wherein said arbor is rotatingly mounted in an additional bridge situated at a lower level relative to said plane of the carrier.

* * * * *